United States Patent [19]

Krupay et al.

[11] Patent Number: 4,837,338

[45] Date of Patent: Jun. 6, 1989

[54] REMOVAL OF IMPURITIES FROM N-METHYL-PYRROLIDONE USING HIGHLY PURE WATER WASHED ACTIVATED ALUMINA

[75] Inventors: Bordan W. Krupay; Lloyd E. Reid, both of Sarnia, Canada

[73] Assignee: Exxon Research and Engineering Company, Florham Park, N.J.

[21] Appl. No.: 874,474

[22] Filed: Jun. 16, 1986

[51] Int. Cl.[4] ..... C07D 207/38

[52] U.S. Cl. ..... 548/555; 502/414; 502/415; 502/416

[58] Field of Search ..... 548/555; 502/414–416

[56] References Cited

U.S. PATENT DOCUMENTS

| | | | |
|---|---|---|---|
| 1,540,446 | 6/1925 | Wilson | 502/414 X |
| 2,615,812 | 10/1952 | Kaufman et al. | 99/125 |
| 2,870,230 | 1/1959 | Scott et al. | 260/674 |
| 2,878,182 | 3/1959 | Block | 208/321 |
| 2,926,135 | 2/1960 | Engel et al. | 208/306 |
| 2,951,804 | 9/1960 | Juliard | 208/91 |
| 2,964,465 | 12/1960 | Brown et al. | 208/314 |
| 3,153,027 | 10/1964 | Hagemeyer et al. | 260/94.9 |
| 3,335,120 | 8/1967 | Hagemeyer et al. | 260/93.7 |
| 3,396,090 | 8/1968 | Van Tassell | 203/73 |
| 3,409,691 | 11/1968 | Small | 260/676 |
| 3,470,087 | 9/1969 | Broughton | 208/321 |
| 3,642,614 | 2/1972 | Van Tassell | 208/321 |
| 3,725,377 | 4/1973 | Cottle | 260/94.2 |
| 3,751,507 | 8/1973 | Walker | 260/674 |
| 3,755,152 | 8/1973 | Gulick | 208/307 |
| 3,803,255 | 4/1974 | Elis et al. | 260/671 |
| 3,919,078 | 11/1975 | Cohen et al. | 208/313 |
| 3,953,324 | 4/1976 | Deal et al. | 208/321 |
| 3,960,846 | 6/1976 | Potin et al. | 548/555 |
| 3,970,711 | 7/1976 | Reiche et al. | 260/635 |
| 4,490,240 | 12/1984 | Comeaux et al. | 208/47 |

FOREIGN PATENT DOCUMENTS

| | | | |
|---|---|---|---|
| 2105252 | 8/1971 | Fed. Rep. of Germany . | |
| 44-17915 | 8/1969 | Japan . | |
| 49-81327 | 8/1974 | Japan . | |
| 2088850 | 6/1982 | United Kingdom . | |
| 1065004 | 1/1984 | U.S.S.R. | 502/514 |

OTHER PUBLICATIONS

"Sulpholane; Purification, Tests for Purity and Properties", J. F. Coetzee, Pure and Applied Chemistry, vol. 49, pp. 211–215, 1977.

"Sulfolanes as Solvents for Potentiometric Titrations", Morman, et al., Analytical Chemistry, vol. 39, No. 14, p. 1869, 1967.

*Primary Examiner*—Glennon H. Hollrah
*Assistant Examiner*—D. B. Springer
*Attorney, Agent, or Firm*—Joseph J. Allocca

[57] ABSTRACT

N-methyl pyrrolidone solvent (hereinafter NMP) used to extract aromatic components from lubricating oil distillates is purified by contacting the solvent with activated alumina.

9 Claims, 2 Drawing Sheets

SCHEMATIC DIAGRAM OF LAB UNIT FOR ADSORBENT EVALUATION

SCHEMATIC DIAGRAM OF LAB UNIT FOR ADSORBENT EVALUATION

REMOVAL OF IMPURITIES FROM N-METHYL-PYRROLIDONE USING HIGHLY PURE WATER WASHED ACTIVATED ALUMINA

BRIEF DESCRIPTION OF THE INVENTION

N-methyl pyrrolidone (NMP) is employed as an aromatic extraction solvent in treating lube oil distillates. Once the aromatics have been extracted from the oil the NMP is separated from the aromatics. This NMP can contain up to 20% oil and also contains corrosive impurities which are detrimental to the extraction plant. These corrosive impurities are removed from the NMP by contacting the NMP with activated alumina which has been washed to remove any sodium oxide present therein. Contacting between the NMP and activated alumina is at any temperature ranging from ambient, or slightly below, to about 200° C.

BACKGROUND OF THE INVENTION

Lubricating oils are extracted using N-methyl pyrrolidone so as to have their aromatics content reduced. This extraction is usually performed at temperatures in the range of about 70° F. to about 300° F. Any hydrocarbon feed that has an initial boiling point at least about 100° F. to 150° F. above the boiling point of pure NMP solvent (399° F.) is a suitable lube oil stock for extraction using NMP. Lube oil feeds comprise petroleum fractions having an initial boiling point of above about 500° F. These fractions include deasphalted oils and/or distillate lube oil fractions boiling within the range of about 600° F. and 1,050° F. (at atmospheric pressure) and contain between about 5% and about 70% (by weight) of polar and aromatic compounds, such as substituted benzenes, naphthalenes, anthracenes and phenanthracenes, characterized by having a carbon content typically in the range of $C_{15}$–$C_{50}$. Non-limiting examples of useful feedstocks include crude oil distillates and deasphalted resids, those fractions of catalytically cracked cycle oils, coker distillates and/or thermally cracked oils boiling above about 600° F. and the like. These fractions may be derived from petroleum crude oils, shale oils, tar sand oils and the like. These fractions may come from any source, such as the paraffinic crudes obtained from Aramco, Kuwait, The Panhandle, North Louisiana, etc., naphthenic crudes, such as Tia Juana and Coastal crudes, etc., as well as the relatively heavy feedstocks, such as Bright Stocks having a boiling range of 1,050° F.+ and synthetic feedstocks derived from Athabasca Tar Sands, etc.

Solvent extracting lube oil fractions using NMP produces raffinate and extract phases containing NMP. Because lube oil extraction with NMP is normally performed at temperatures below about 300° F. it is necessary to heat the NMP containing phases to higher temperatures in order to separate the solvent therefrom if thermal recovery means are used. Generally, this temperature must be at least 400° F. in order to separate the oil and solvent, using either flash evaporation and/or distillation, because NMP boils at about 395° F. or higher, depending on its purity. This minimum thermal separation temperature is readily achieved by heating the solvent containing phases in heat exchangers, such as direct fired tube furnaces, and then passing the hot raffinate and/or extract solutions to flash towers, distillation towers or combinations thereof. The bulk temperature of the hot, solventcontaining oil often exceeds 500° F. and portions thereof may even exceed temperatures in excess of 700° F. Material contained in the thin boundary layer film inside the furnace tubes may be heated to temperatures of 800° F. or more, particularly in the radiant section of the furnace.

It has been found that NMP significantly decomposes when heated to temperatures at or above 700° F.

Beyond this, however, even NMP recovered at 600° F. and higher contains a significant quantity of contaminants which are detrimental to the structural integrity of the recovery circuit. At the high temperatures encountered in the NMP recovery circuit of a lube oil extraction process chemical reactions occur which are not observed in other extraction solvent recovery schemes. For example, in solvent recovery schemes in aromatics extraction processes practiced in the chemical industry the solvent, since it boils at a temperature higher than the extract/oil, is recovered at a lower temperature in the 150° F. to 350° F. range and, therefore, thermal decomposition and chemical conversion of contaminants are minimized, if not totally avoided.

In the recovery of NMP in lube oil extraction processes use of the high recovery temperatures (600° F.) result in the conversion of dissolved salts, such as sodium chloride, to hydrochloric acid, iron sulfide to hydrogen sulfide. Further, lube distillate feeds contain organo-sulfur and organo-nitrogen compounds which are known to degrade to form hydrogen sulfide and ammonia at the temperatures involved. Lube distillate feeds can also contain naphthenic acids and/or functional groups which are not acidic but which are converted to organic acids at the temperatures encountered in the extract recovery section.

Thus, the impurities present in NMP recovered by distillation from lube oil distillate extraction processes are different from those present in extraction solvents utilized in aromatics recovery processes in the chemical industry.

It would be advantageous to the extraction process if these impurities and contaminants could be removed from the recovered NMP so as to essentially eliminate this detrimental effect on the extraction plant.

DETAILED DESCRIPTION OF THE INVENTION

Figure 1:
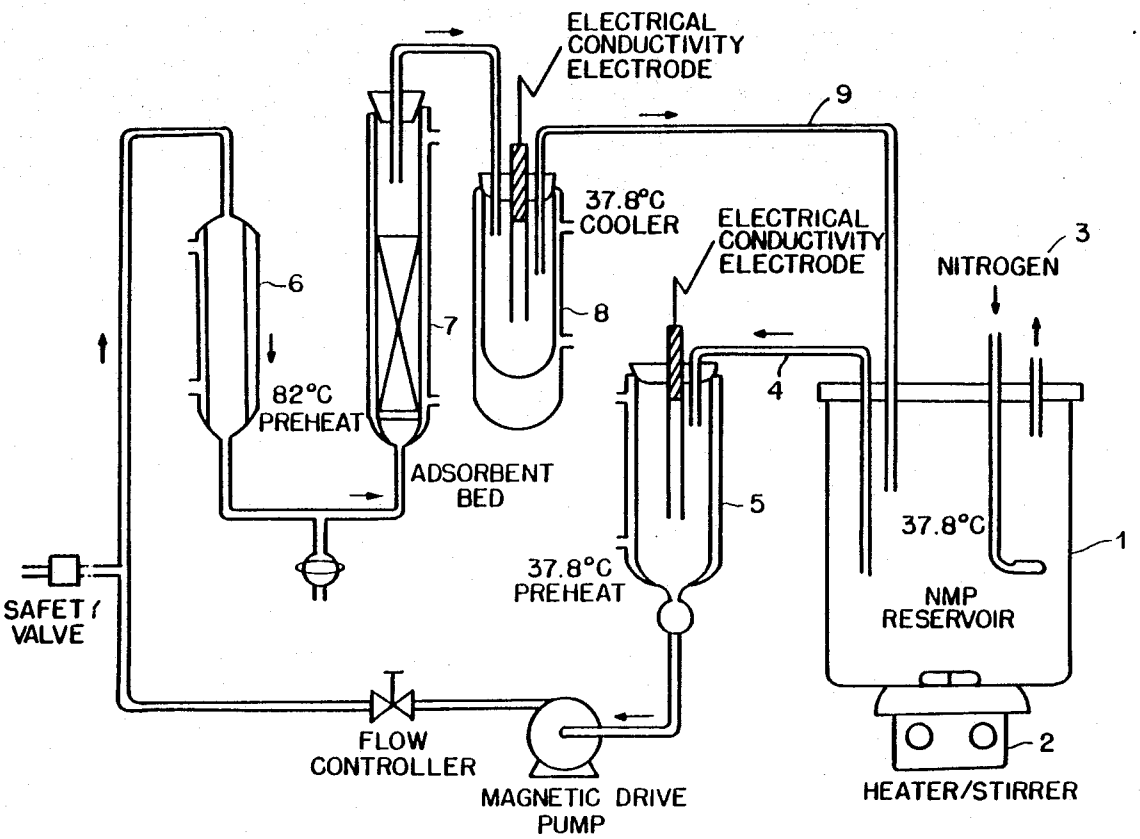
FIG. 1 is a schematic of the test apparatus used.

N-methyl pyrrolidone (NMP) used to extract aromatic compounds from heavy oil feedstocks, e.g., those boiling above about 500° F., preferably above about 600° F., especially lubricating oil distillate or specialty oil feedstocks, is usually separated from the resultant extract and raffinate streams by distillation at temperatures above about 500° F., whereby the NMP is the distillate. This recovered NMP contains a not insignificant quantity of impurities and corrosive constituents, such as heavy naphthenic acids, hydrochloric acid, hydrogen sulfide, sulfuric acid, ammonia and other ionic materials which are detected by the increased electrical conductivity (EC) and total acid number (TAN) of the NMP stream. These contaminants are detrimental to the structural integrity of the extraction plant. In addition to the above recited impurities the NMP also contains oil, wax, other particulate matter and water. This recovered NMP is purified by contacting said NMP with activated alumina which has been water washed, if necessary, to reduce the quantity of sodium oxide present on the alumina.

Activated alumina was found to be superior to other commonly used adsorbents, such as attapulgus clay, zinc oxide, activated carbon and silica gel, in removing acidic compounds as indicated by changes in pH and total acid number of treated plant solvent - see Table I. Contacting between the recovered NMP and the activated alumina is at temperatures between about 10° C. to 200° C., preferably about ambient to about 150° C., more preferably about 60° C. to about 100° C.

TABLE I

ADSORBENTS FOR REMOVING CORROSIVE CONTAMINANTS FROM RECOVERED NMP

| Adsorbent | Total Acid Number mg KOH/g | pH[1] |
|---|---|---|
| Plant Solvent | 1.13 | 4.7 |
| Attapulgus Clay | 1.10 | 4.3 |
| Activated Alumina | 0.43 | 6.0 |
| Zinc Oxide | 1.03 | 4.7 |
| Activated Carbon | 1.06 | 4.4 |
| Silica Gel | 1.01 | 4.1 |
| Activated Alumina (Water Washed) | 0.20 | 6.0 |

[1]One part of sample diluted in nine parts deionized water.

The NMP is contacted with the activated alumina at a rate of between about 0.2 to about 20 LHSV, preferably between about 5 to 10 LHSV. Utilization of lower LHSV is preferred as those skilled in the art understand that better capacity and higher efficiencies are achieved at the lower rates.

The activated alumina which can be used in the process of the present invention is any of the commercially available activated alumina material on the market. Activated aluminas are available in various mesh sizes. While activated alumina of any mesh size can be used, and will be effective in reducing the level of contaminant in the recovered NMP, it has been discovered that activated alumina of the smaller mesh sizes is preferred. Activated alumina of a mesh particle size of 14×28 (USA) was more effective in reducing the electrical conductivity of recovered NMP than was the next larger size (8×14 mesh). The smaller particle size activated alumina treats a greater volume of NMP before it is exhausted than does larger particle size activated alumina, in addition to reducing the electrical conductivity to a lower level.

Activated alumina as produced contains from 0.35 weight percent to 0.90 weight percent sodium oxide, depending on the manufacturer. The removal of the sodium oxide is necessary in order to avoid contamination of the NMP solvent with sodium oxide. In addition, lab results indicate that the capacity of the activated alumina for removing acids improved as the sodium oxide content was reduced (Table I). Water washing can remove about 68% of the sodium oxide, the remaining 32% stays in the micropores of the activated alumina which are inaccessible to water. On this basis, the activated alumina manufactured by Kaiser is preferred because the sodium oxide content is only about 0.35 weight percent. This requires less volume of water for sodium oxide removal than products from other manufacturers which can contain 0.90 weight percent sodium oxide. The pretreatment to remove sodium oxide from the activated alumina product can be achieved with water at >82° C. (180° F.).

Since the quantity of water used can vary depending on the quality of the water employed, it is more convenient to describe the washing in terms of the electrical conductivity of the washings. Therefore, washing is continued until the electrical conductivity of the alumina is reduced to about 150 micro mho/cm and less, preferably about 100 micro mho/cm and less.

The NMP which is contacted with the activated alumina should be relatively dry, that is, contain 0 to 3 LV% water. It is important that the NMP be relatively dry since at higher levels some of the adsorbed acids (on the alumina) would be expected to desorb into the aqueous NMP (or not be adsorbed in the first place) as a result of the water competing for the active adsorption sites on the activated alumina.

A schematic representation of the lab unit for testing the effectiveness of activated alumina for the removal of impurities from NMP streams is shown in FIG. 1. These tests were conducted in both a recycle and a once through operation. In this recycle system the solvent is placed in the feed reservoir (1), stirred (2) under a small nitrogen purge (3) and drawn continuously via line 4 into a preheat vessel (37.8° C.) (5) where the electrical conductivity is measured. The solvent is then preheated in heater 6 to 82° C. and passed up-flow over the activated alumina bed (7) (60 g) at 10 ml/min. (LHSV 10). A thermostated cooler containing an electrical conductivity electrode (8) is used to measure the electrical conductivity of the treated effluent at 37.8° C. as it flows back via line 9 into the main NMP reservoir. The once-through experiments were conducted at 37.8° C., using 30 g of activated alumina at a flow rate of 7.5 ml/min. over the bed (LHSV 15).

Three mesh sizes of activated alumina (supplied by Kaiser) were evaluated in the lab unit (FIG. 1). Each of the mesh sizes was first extracted with hot water to remove about 68% of the total sodium oxide (0.35 weight percent) present on the activated alumina. The remaining sodium oxide is in micropores and inaccessible to water. The dried activated alumina (60 grams) was loaded into the lab unit to treat 12 liters of Baytown NMP containing 1 LV% water, 6.0 LV% light oil at 10 LHSV (10 ml/min.).

For all mesh sizes the electrical conductivity (EC) of the reservoir decreased linearly with the total volume of NMP passed through the bed. The EC begins to approach a limiting value as the activated alumina becomes spent. The point at which the alumina becomes exhausted is indicated by the EC of the feed to the bed, which becomes the same as the bed effluent.

The effect of alumina particle size on the removal of electrically conductive species is summarized in Table II.

The smallest mesh size particles (14×28) were the most effective in reducing the electrical conductivity of the treated NMP. The total volume of NMP circulated through the bed was 24 liters before the activated alumina was spent, at which time the NMP electrical conductivity was 1.4 micro mho/cm (reduced from 3.1 micro mho/cm). In the case of the next larger size particles (8×14 mesh) the electrical conductivity of the total NMP was reduced to 2.0 micro mho/cm before the activated alumina was spent after a total volume of 16 liters of the recycle NMP was passed through the bed. The 5×8 spheres showed poorer performance, yet the NMP electrical conductivity was reduced to 2.1 micro mho/cm and the activated alumina was spent after 16 liters of recycle NMP were passed through the bed. It should be noted that although the electrical conductivity of the untreated (fresh) NMP used in the latter two mesh sizes evaluations was lower than the first case the linear decrease of electrical conductivity with volume passed through the bed was also observed in evaluating the 8×14 granules and 5×8 beads of activated alumina. Thus, the 14×28 mesh activated alumina showed the better performance in removing the electrically conductive species from the NMP solvent.

The capacity of activated alumina for removing titratable acids from the NMP is also summarized in Table II.

TABLE II

EFFECT OF PARTICLE SIZE ON ACTIVATED ALUMINA PERFORMANCE[1]

| Mesh Size | Electrical Conductivity micro mho/cm Initial | Final | Volume Recycled[2] Liters | Total Acid Number mg KOH/g Initial | Final | % Reduction |
|---|---|---|---|---|---|---|
| 14 × 28 | 3.1 | 1.4 | 24 | 0.18 | 0.11 | 35 |
| 8 × 14 | 2.5 | 2.0 | 16 | 0.18 | 0.13 | 28 |
| 5 × 8 | 2.5 | 2.1 | 16 | 0.18 | 0.14 | 22 |

[1]60 grams KAISER activated alumina; 12 liters Baytown NMP; 82° C. temperature; 10 ml/min flow rate; LHSV = 10 $hr^{-1}$.
[2]Total volume of solvent passed through bed before alumina spent with respect to removing electrically conductive material.

The 14×28 mesh removed 35% of the titratable acids compared to 28% for the 8×14 mesh particles and 22% for the 5.8 mesh beads.

Before the next stage in the operation sequence is started it is necessary to recover the NMP held upon the spent alumina. NMP retained in the pores of the activated alumina is flushed from the activated alumina (while the adsorbent impurities are left behind) by washing the NMP-saturated activated alumina with a light raffinate oil, such as a 60N raffinate oil at a temperature of between about 50° C. to about 150° C. at a flow rate of about 0.2 to about 20 LHSV.

Once the NMP trapped in and on the activated alumina has been removed therefrom the activated alumina itself must now be regenerated, that is, the adsorbent impurities must be removed. This can be accomplished by washing the spent activated alumina with water at from about 50° C. to about 150° C., at a pressure of about 14 to about 200 psig. The water is passed over the spent activated alumina at a rate between about 0.2 to about 30 LHSV, preferably about 0.5 to about 20 LHSV.

In the regeneration of the spent activated alumina, water washing at 82° C. and then at 150° C. (1.14 MPa) was proposed based on experiments using plant NMP.

TABLE III

REGENERATION OF SPENT ACTIVATED ALUMINA[1]

| Electrical Conductivity micro mho/cm Initial | Final | Volume[2] Recycled Liters | Total Acid Number mg KOH/g Initial | Final | % Reduction | Regeneration Temperature °C. |
|---|---|---|---|---|---|---|
| 3.1 | 1.4 | 24 | 0.18 | 0.11 | 35 | 82 |
| 1.4 | 1.0 | 11 | 0.11 | 0.10 | 9 | 82/150 |
| 2.5 | 1.5 | 25 | 0.19 | 0.14 | 26 | — |

[1]60 grams KAISER activated alumina (14 × 28 mesh); 12 liters Baytown NMP; 82° C.; 10 cc/min.; LHSV = 10 $hr^{-1}$.
[2]Total volume of solvent passed through bed before alumina spent.

These experiments were conducted with 14×28 mesh activated alumina (60 grams) from Kaiser in the apparatus shown in FIG. 1. The solvent reservoir contained 12 liters of NMP which was pumped through the activated alumina at 82° C. and 10 LHSV. The final electrical conductivity of the reservoir NMP was 1.4 micro mho/cm (Table III), while 35% of the titratable acids had been removed when the alumina was spent. An attempt to regenerate this spent activated alumina was then conducted at 82° C. only. Using the recycle NMP product from the above experiment it was found that the original capacity of the activated alumina for removing electrically conductive species and titratable acids was partially restored by this regeneration approach. The above activated alumina was spent again after only 11 liters of recycle NMP had been pumped through the bed, at which point the electrical conductivity had been reduced from 1.4 to about 1.0 micro mho/cm and the reduction in titratable acids was 9%.

In view of the above, attempts to regenerate the spent activated alumina with water were then conducted at two temperatures, 82° C. followed by 150° C. Using a fresh sample of contaminated, untreated NMP (2.5 micro mho/cm), the two-temperature treated activated alumina decreased the electrical conductivity of the NMP sample to 1.5 micro mho/cm, compared to 1.4 micro mho/cm for the fresh activated alumina. The removal of titratable acids was also improved; the fresh activated alumina reduced the titratable acid level of the NMP by 35%, whereas the activated alumina treated by the two-temperature water wash reduced the titratable acid level by 26%. Thus, conducting the water wash regeneration at two temperatures was more effective than the single temperature regeneration. The lower temperature water wash removes soluble iron compounds and reduces the extent of hydrolysis to form inorganic precipitates that could deactivate and/or foul the bed. The high temperature water wash then removes the more strongly held polar compounds and/or the less soluble organic components. When employing this preferred two-temperature water wash procedure, the temperature of the lower temperature wash is in the range of about 20° to about 120° C., preferably about 80° to about 100° C. The higher temperature wash is in the range of about 120° to 200° C., preferably about 150° to 170° C. The volume of water used in each wash depends on the amount and type of adsorbed impurities. Washing is carried out at each temperature until the electrical conductivity of the washing reaches a final steady value. This will depend on the purity of the water used for washing the activated alumina.

Figure 2:
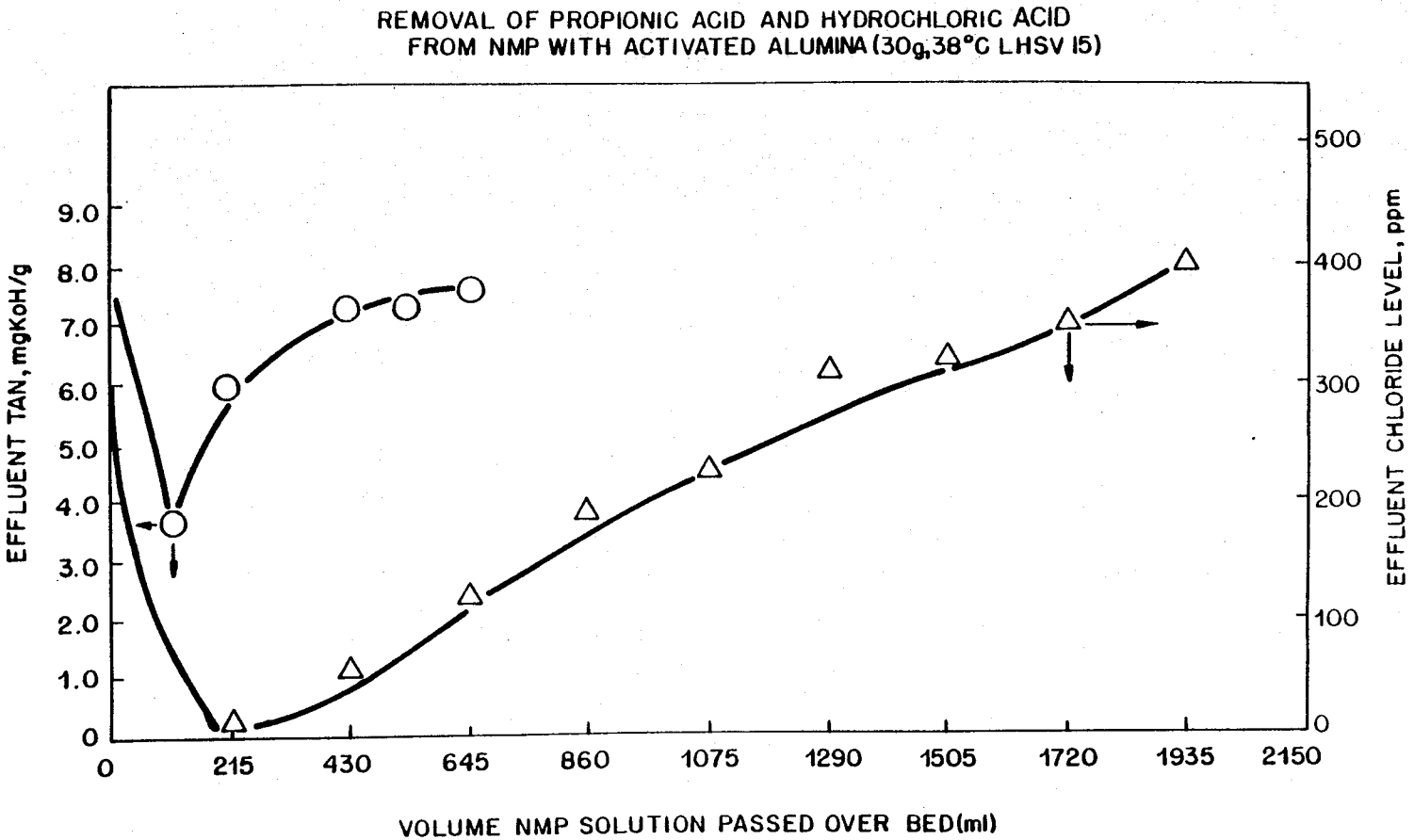
FIG. 2 is a graph reporting the degree of removal of propionic and hydrochloric acid from NMP in terms of TAN versus volume of NMP passed over the activated alumina bed.

The capacity of activated alumina for propionic acid and HCl was determined individually using NMP spiked with 10,000 ppm of propionic acid or 500 ppm HCl. These experiments were conducted at 37.8° C. in a once-through operation (see Table IV and FIG. 2).

In a plant test, a 5,300 pound bed of activated alumina (Kaiser A2, 14×28 mesh) was tested by treating a slip stream of the recycle NMP. The NMP rate through the bed was about 1% of the total recycle NMP flow rates. The water pretreatment required about 150 barrels of condensate water (140 psig, 230° F.) to reduce the sodium oxide content to acceptable levels. This was determined by monitoring the electrical conductivity of the effluent water using a commercially available electrical conductivity bridge. Washing was performed by passing the water through the body of activated alumina. The washing was stopped when the electrical conductivity of the washings dropped below 100 micro mho/cm. Using higher temperature steam condensate (340° F., 150 psig) would be expected to reduce the amount of water required to about 100 barrels for a similar quantity of alumina.

Following exposure of the 5,300 pound bed of activated alumina (utilized in a plant test) to the 1% slip stream of NMP for about 17 days, the spent activated alumina was regenerated by washing with 20 barrels of waxy raffinate (80° C., 0.6 LHSV) in a downflow mode completely displacing the NMP held within the bed.

The 5,300 pound bed of Kaiser A2 activated alumina in the plant test was then washed by two-temperature water washing, the first low temperature regenerative water wash was carried out at 82° C., 0.66 LHSV requiring about 230 barrels of water before the electrical conductivity of the effluent reached a constant level. This was then followed with about 100 barrels of 150° C. steam condensate (at 150 psig, 0.66 LHSV) to reduce the effluent electrical conductivity below 100 micro mho/cm. The regenerated activated alumina operated on the 1% slip stream for about 47 days before it was spent. The bed was taken out of service by closure of the slip stream valves. Prior to being taken out of service, the evaluation of slip stream inlet and outlet (pre- and post-exposure to the activated alumina) showed that the adsorbent was more efficient when the electrical conductivity of the inlet feed exceeded about 4–5 micro mho/cm.

TABLE IV

REMOVAL OF PROPIONIC ACID AND HYDROCHLORIC ACID FROM NMP WITH ACTIVATED ALUMINA

| Cut No. | Volume NMP Over Bed | Effluent Acid Levels: Propionic Acid Run(1) TAN, mg KOH/g | Effluent Acid Levels: HCl Run(2) Chloride, ppm |
|---|---|---|---|
| 0 | 0 | 7.80 | 469 |
| 1 | 112.5 | 3.53 | 5 |
| 2 | 215 | 5.87 | 9 |
| 3 | 318 | 6.67 | 29 |
| 4 | 430 | 7.17 | 56 |
| 5 | 328 | 7.35 | 80 |
| 6 | 645 | 7.66 | 119 |
| 7 | 758 | | 160 |
| 8 | 860 | | 190 |
| 9 | 973 | | 224 |
| 10 | 1075 | | 223 |
| 11 | 1188 | | 288 |
| 12 | 1290 | | 310 |
| 13 | 1403 | | 308 |
| 14 | 1505 | | 321 |
| 15 | 1618 | | 346 |
| 16 | 1720 | | 347 |
| 17 | 1832.5 | | 375 |
| 18 | 1935 | | 402 |
| 19 | 2038 | | 440 |

TABLE IV-continued

REMOVAL OF PROPIONIC ACID AND HYDROCHLORIC ACID FROM NMP WITH ACTIVATED ALUMINA

| Cut No. | Volume NMP Over Bed | Effluent Acid Levels: Propionic Acid Run(1) TAN, mg KOH/g | Effluent Acid Levels: HCl Run(2) Chloride, ppm |
|---|---|---|---|
| 20 | 2150 | | 469 |

(1)Feed = NMP with 10,000 ppm propionic acid.
(2)Feed = NMP with 500 ppm hydrochloric acid.

Based on these results the capacity of activated alumina for propionic acid is 0.57 meq. acid per gram of adsorbent, while for hydrochloric acid the corresponding capacity was 0.46 meq./gram of adsorbent.

Carbon steel specimens were exposed to a treated plant solvent slip stream sample and an untreated plant solvent sample for six days at 100° C. At the end of the test period the corrosion rate in the untreated solvent was 4.2 mils/year, compared to 0.7 mils/year for the treated solvent, Table V. The 1% NMP slip stream from which this sample of treated solvent was taken was returned to the main body of the NMP solvent used for extraction. Because of the extremely limited volume of NMP treated using the 5,300 pound activated alumina bed, the return of the slip stream to the main volume of NMP produced no noticeable change in the electrical conductivity of the total solvent pool. The degree of impurity reduction, calculated to be on the order of about 3% in the total solvent pool, is smaller than the experimental error of the measurement techniques used to determine the level of impurity in the total pool solvent samples.

TABLE V

CORROSION COUPON TESTS IN TREATED AND UNTREATED PLANT NMP USING ACTIVATED ALUMINA (100° C. For Six Days)

| Description | Electrical Conductivity macro mho/cm at 37.8° C. | Total Acid Number mg KOH/g | Water Content LV % | Corrosion Rate mils/year |
|---|---|---|---|---|
| Non-treated | 4.12 | 0.94 | 1.40 | 4.2 |
| Treated | 2.29 | 0.39 | 1.59 | 0.7 |

The reduced corrosiveness of the treated NMP is attributed to the removal of acidic, as well as unidentified contaminants (as indicated by the lower electrical conductivity of the treated sample).

What is claimed is:

1. In the method for removing contaminants from N-methyl pyrrolidone (NMP) by the adsorption of said contaminants by use of an adsorbent, the improvement comprising using as the adsorbent activated alumina which is water washed until the electrical conductivity of the wash water is about 100 micro mho/cm or less prior to its use as the adsorbent.

2. The method of claim 1 wherein the activated alumina possesses a size of about 14×28 mesh.

3. The method of claim 1 wherein the contacting between the NMP and the activated alumina is at a temperature of between about 10° to 200° C.

4. The method of claim 1 wherein the NMP is contacted with the activated alumina at a rate of between about 0.2 to about 20 LHSV.

5. The method of claim 1 wherein the NMP which is contacted with the activated alumina contains from 0 to 3 LV% water.

6. The method of claim 1 wherein, after the adsorption of contaminants by the adsorbent, any NMP trapped in the adsorbent is removed therefrom by washing with a light raffinate oil.

7. The method of claim 6 wherein the washing with a light raffinate oil is performed at a temperature of between 50° to about 150° C., at a flow rate of about 0.2 to about 30 LHSV.

8. The method of claim 6 wherein following the washing of the adsorbent with light raffinate oil the activated alumina adsorbent is regenerated by washing with water until the wash water has an electrical conductivity of about 100 micro mho/cm or less, and recycling the regenerated water washed alumina to the adsorbtion zone.

9. The method of claim 8 wherein the water washing to remove impurities is conducted at two temperatures, the first washing being conducted at a temperature of between about 20° to 120° C. and the second washing at a temperature of between about 120° to 200° C.

* * * * *